US006363577B1

(12) United States Patent
Spitzley

(10) Patent No.: US 6,363,577 B1
(45) Date of Patent: Apr. 2, 2002

(54) MOTOR VEHICLE DOOR HANDLE ASSEMBLY WITH MAXIMIZED BEARING INTERFACE

(75) Inventor: Larry W. Spitzley, Mulliken, MI (US)

(73) Assignee: Adac Plastics, Inc.

( * ) Notice: Subject to any disclaimer, the term of this patent is extended or adjusted under 35 U.S.C. 154(b) by 0 days.

(21) Appl. No.: 09/648,844

(22) Filed: Aug. 25, 2000

(51) Int. Cl.[7] ..... E05B 3/00

(52) U.S. Cl. ..... 16/412; 16/438; 16/DIG. 41; 292/347; 292/348

(58) Field of Search ..... 16/412, 418, 438, 16/445, DIG. 41; 292/347, 348, DIG. 63; 403/70, 150, 157

(56) References Cited

U.S. PATENT DOCUMENTS

| | | | | |
|---|---|---|---|---|
| 3,159,415 A | | 12/1964 | Sandor | |
| 3,507,132 A | | 4/1970 | Schwenk | |
| 3,719,248 A | | 3/1973 | Breitschwerdt et al. | |
| 4,038,718 A | | 8/1977 | Reilhac et al. | |
| 4,343,501 A | | 8/1982 | Meeks | |
| 4,482,179 A | | 11/1984 | Johnson | |
| 4,591,196 A | * | 5/1986 | Kurita | 292/336 |
| 4,924,582 A | * | 5/1990 | Keller | 292/336.3 |
| 5,183,302 A | | 2/1993 | Pelachyk et al. | |
| 5,263,750 A | | 11/1993 | Smith et al. | |
| 5,282,657 A | | 2/1994 | Clinch et al. | |
| 6,036,244 A | * | 3/2000 | Tyves et al. | 292/348 |
| 6,042,159 A | | 3/2000 | Spitzley et al. | |
| 6,059,329 A | | 5/2000 | Spitzley | |
| 6,234,548 B1 | * | 5/2001 | Mittelbach et al. | 292/348 |

* cited by examiner

*Primary Examiner*—Chuck Y. Mah
(74) *Attorney, Agent, or Firm*—Young & Basile

(57) ABSTRACT

A motor vehicle door handle assembly including a housing structure adapted to be mounted on a vehicle door and a handle pivotally mounted at one end thereof on the housing structure at an arcuate bearing interface. The bearing interface comprises an inner bearing interface comprising coacting first and second arcuate surfaces and an outer bearing interface spaced radially outwardly from the inner bearing interface and comprising coacting third and fourth arcuate surfaces. All of the arcuate surfaces are centered on the handle pivot axis. The first arcuate surface comprises a radially outwardly facing handle surface; the second arcuate surface comprises a radially inwardly facing housing structure surface; the third arcuate surface comprises a radially inwardly facing handle surface; and the fourth arcuate surface comprises a radially outwardly facing housing structure surface. Assembly of the handle assembly is facilitated by the provision of a separate pivot member which is positioned on a pin structure defined at one end of the handle and which coacts with the pin structure to define the inner bearing interface. The outer bearing interface is defined by a journal surface on the handle in radially outwardly spaced concentric relation to the pin structure and a convex outer surface of an arcuate trunnion structure of the housing.

10 Claims, 4 Drawing Sheets

MOTOR VEHICLE DOOR HANDLE ASSEMBLY WITH MAXIMIZED BEARING INTERFACE

FIELD OF THE INVENTION

This invention relates to door handle assemblies and more particularly to door handle assemblies especially suitable for motor vehicle usage.

BACKGROUND OF THE INVENTION

Vehicle doors typically include a latch mechanism for latching and unlatching the door to the vehicle body and a handle assembly operative to control the latch mechanism. The handle assembly is typically positioned on the door of the vehicle. It is imperative that the door handle assembly maintain a firm positive pivotal action even over extended periods of vehicle life. It is further imperative that the door handle assembly be resistant to the intrusion of weather elements into the interior of the door through the door handle assembly. It is further desirable that the door handle assembly present a clean, uncluttered, aesthetically pleasing appearance to complement the overall vehicle styling.

SUMMARY OF THE INVENTION

This invention is directed to the provision of an improved door handle assembly for use with a vehicular door.

More specifically, this invention is directed to the provision of a vehicular door handle assembly that maintains a firm positive pivotal action even over extended periods of vehicle life, that is resistant to the intrusion of weather elements into the interior of the door through the door handle assembly, and that presents a clean, uncluttered, aesthetically pleasing appearance to complement the overall vehicle styling.

The door handle assembly of the invention is of the type including a housing structure adapted to be mounted on a vehicle door and a handle pivotally mounted on the housing structure at an arcuate bearing interface centered on the handle pivot axis and controlling a latch mechanism for latching and unlatching the door.

According to the invention, the bearing interface comprises an arcuate inner bearing interface comprising coacting first and second arcuate surfaces on the housing structure and on the handle respectively and an outer bearing interface spaced radially outwardly from the inner bearing interface and comprising coacting third and fourth arcuate surfaces on the housing structure and on the handle respectively. This bearing interface arrangement maximizes total bearing interface area to prolong the effective life of the pivotal joint and eliminates the necessity for exposed pivot pin structures in the handle assembly whereby to resist the intrusion of weather elements into the interior of the door through the handle assembly and present an aesthetically pleasing appearance.

According to a further feature of the invention, the first arcuate surface comprises a radially outwardly facing handle surface; the second arcuate surface comprises a radially inwardly facing housing structure surface; the third arcuate surface comprises a radially inwardly facing handle surface; and the fourth arcuate surface comprises a radially outwardly facing housing structure surface. This specific arrangement of the various arcuate surfaces provides a simple and effective arrangement for maximizing the bearing interface.

According to a further feature of the invention, the housing structure comprises a main body member adapted to be mounted on the vehicle door and a pivot member mounted on the main body member in concentric relation to the pivot axis and the second arcuate surface is defined by the pivot member and the fourth arcuate surface is defined by the main body member. The provision of a separate pivot member facilitates the assembly of the door handle assembly.

According to a further feature of the invention, the first arcuate surface is defined by a pin structure on one end of the handle and the third arcuate surface is defined by a journal surface on the one handle and in radially outwardly spaced concentric relation to the pin structure. This specific handle construction facilitates the provision of the maximized bearing interface.

According to a further feature of the invention, the fourth arcuate surface is defined by a convex outer surface of an arcuate trunnion structure of the handle structure interposed concentrically between the pin structure and the third arcuate surface. The trunnion structure in coaction with the handle structure, provides a simple and effective means of providing the required bearing interface surfaces.

According to a further feature of the invention, the handle includes a longitudinal fin structure at one end thereof; the pin structure includes portions extending transversely from opposite spaces of the fin structure; the trunnion structure includes a longitudinal slot sized to pass the fin structure and a transverse slot intersecting the longitudinal slot and sized to pass the pin structure; and the handle is assembled to the housing structure by passing the pin structure and the fin structure downwardly through the transverse and longitudinal slots respectively to position the journal surface against the outer convex surface of the trunnion structure and position the pin structure beneath and within the hollow of the trunnion structure. This arrangement facilitates the assembly of the handle.

According to a further feature of the invention, the trunnion structure further defines a concave inner surface in concentric relation to the fin structure on the handle and the pivot member is positioned between the inner concave surface of the trunnion structure and the pin structure and includes a longitudinal slot aligned with the longitudinal slot in the trunnion structure and receiving the longitudinal fin structure and transverse slots in opposite sides of the longitudinal slot aligned with the transverse slot in the trunnion structure and receiving the respective pin structure portions. This specific arrangement further facilitates the ready assembly of the handle.

According to a further feature of the invention, the handle assembly further includes coacting detent structures on the pivot member and on the concave inner surface of the trunnion structure operative in response to rotation of the pivot member about the handle pivot axis to lock the pivot member with respect to the main body handle member. This arrangement provides a ready and efficient means of locking the pivot member in its operative position.

According to a further feature of the invention, the pivot member has an overall U-configuration in cross section. This specific cross-sectional configuration facilitates the positioning of the pivot member around the pin structure of the handle and subsequent rotation of the pivot member about the handle pivot axis to its detented position.

The bearing interface construction of the invention further allows the handle pivot axis to be at a relatively "high" location that is essentially planar with respect to the outer skin of the associated door without requiring an exposed pivot pin hole in the handle housing member which is aesthetically displeasing and which invites the intrusion of weather elements into the interior of the door through the handle assembly. The "high" location of the pivot axis relative to the door skin and the handle housing member in turn reduces the gap between the closed position of the handle and the handle housing member required to allow opening movement of the handle to operate the latch. Reduction of the gap is aesthetically pleasing from a styling standpoint and further reduces the possibility of intrusion of weather elements into the interior of the door through the handle assembly.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
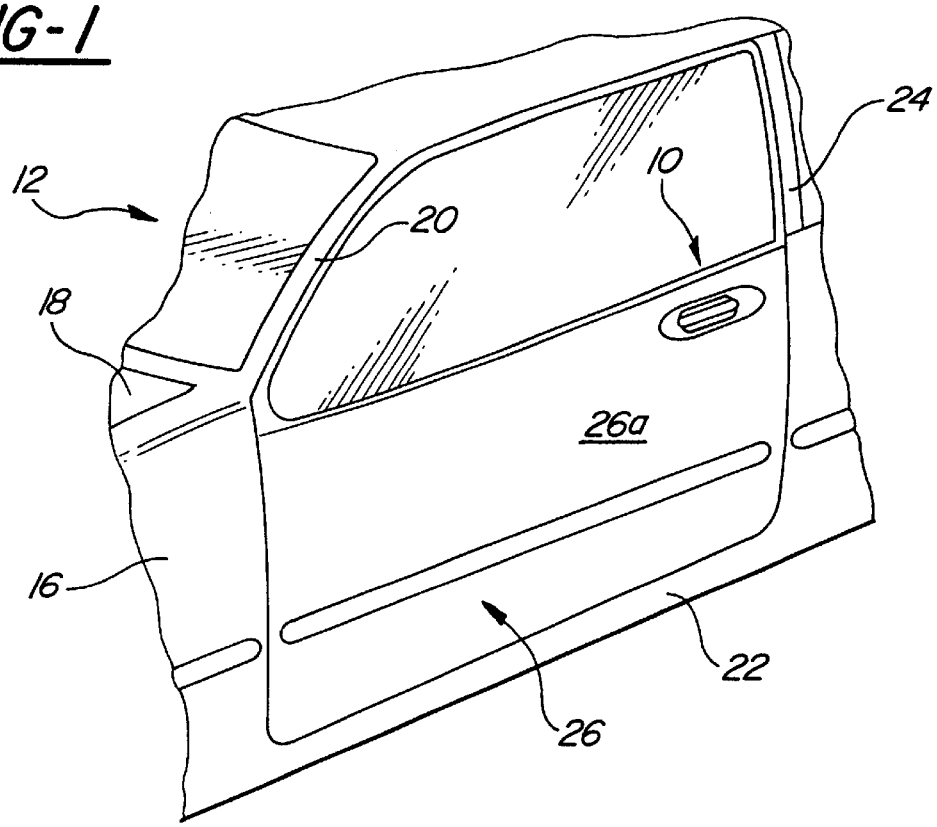
FIG. 1 is a fragmentary perspective view of a motor vehicle including a door embodying the door handle assembly of the invention.
Figure 3:
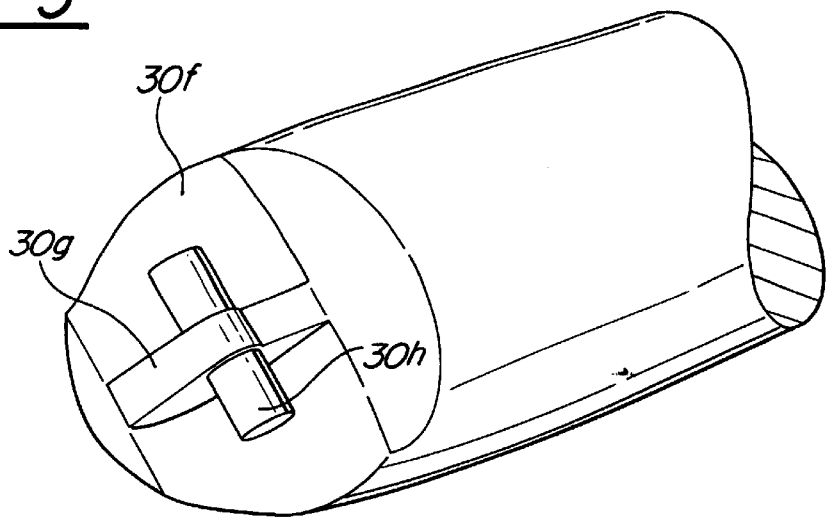
FIG. 3 is a fragmentary perspective view of a handle member utilized in the invention door handle assembly.
Figure 2:
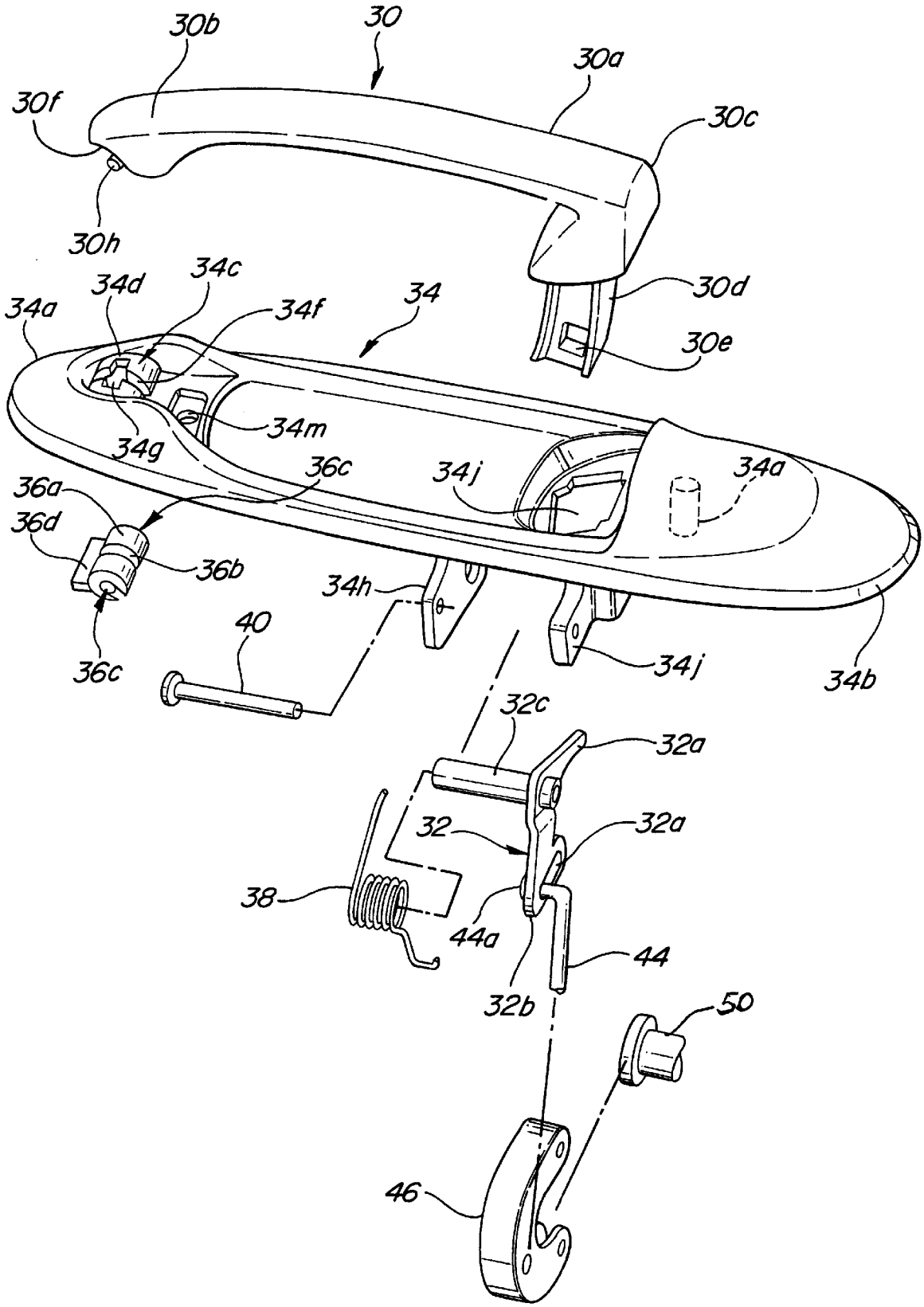
FIG. 2 is an exploded view of the invention door handle assembly.
Figure 4:
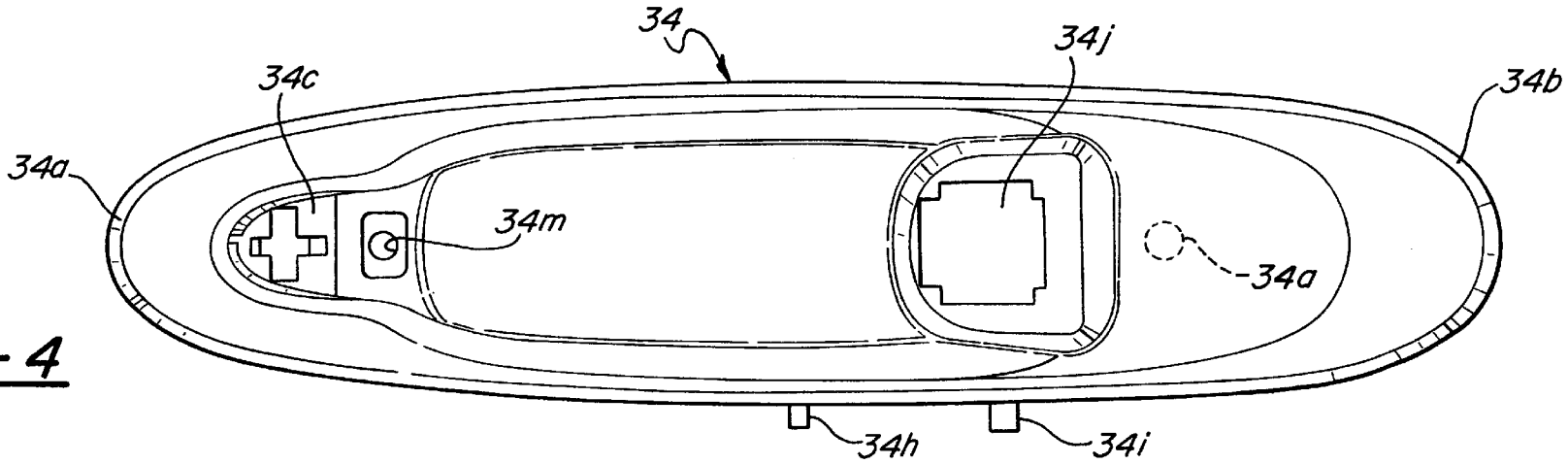
FIG. 4 is a plan view of a housing utilized in the invention door handle assembly.
Figure 7:
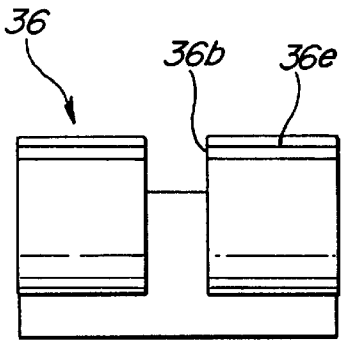
FIGS. 5, 6, and 7 are plan, side, and end views respectively of a pivot member utilized in the invention door handle assembly.
Figure 6:
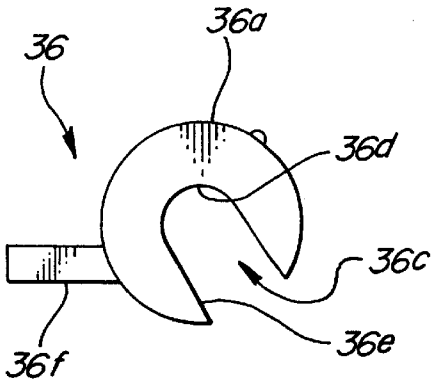
Figure 5:
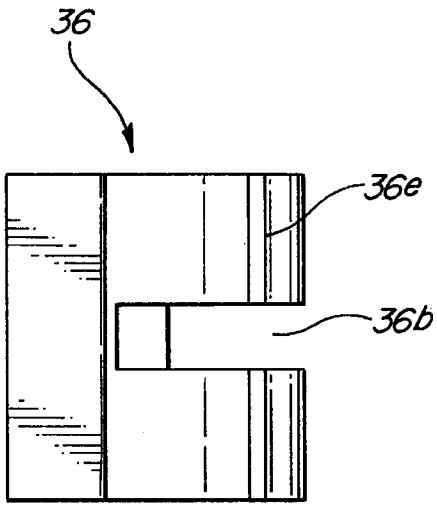
Figure 8:
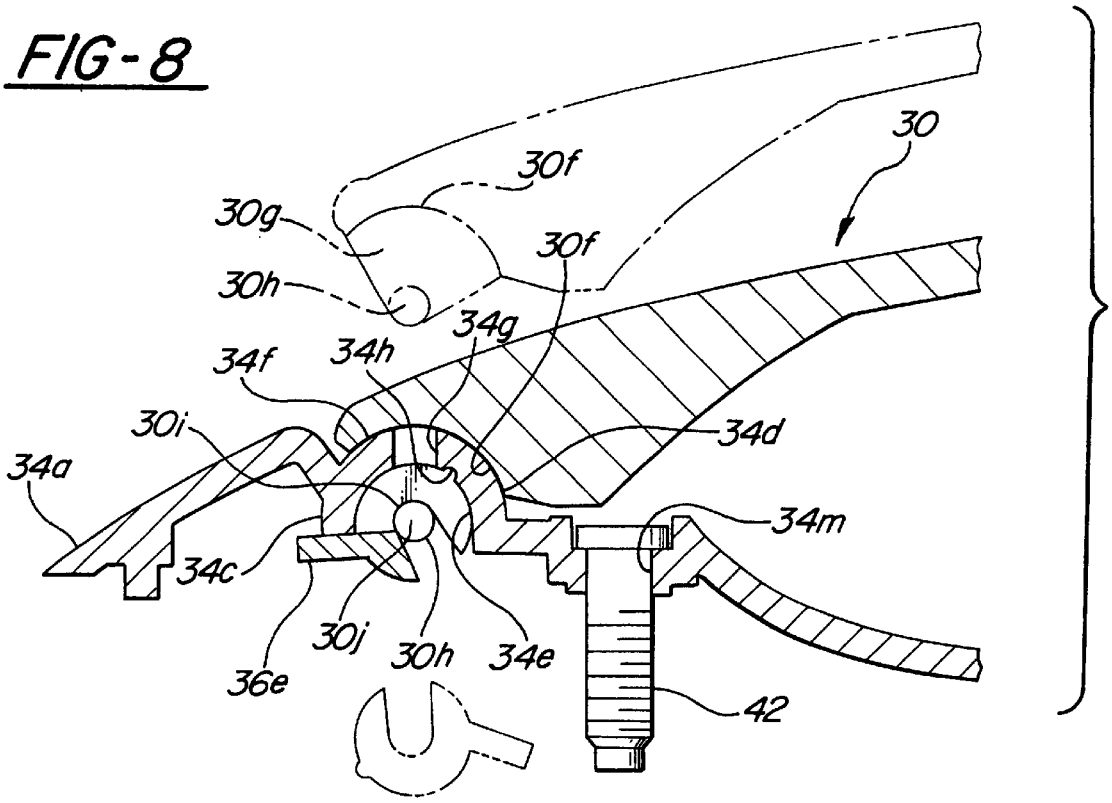
FIG. 8 is a fragmentary somewhat schematic view illustrating the assembly of the invention door handle assembly.

The invention door handle assembly 10 is seen in FIG. 1 in association with a fragmentarily shown motor vehicle 12 including a front quarter panel 16, a hood 18, an A-pillar 20, a sill 22, a B-pillar 24, and a door 26 positioned in the door opening defined by A-pillar 20, front quarter panel 16, sill 22, and B-pillar 24.

Door handle assembly 10, broadly considered, includes (FIGS. 2–8) a housing structure 28, a handle 30, and a bell crank 32.

Housing structure 28 includes a main body member 34 and a pivot member 36.

In the following detailed description and in the claims, the term "arcuate" is intended to refer to all or a portion of a circular line.

Main body member 34 has an elongated oval configuration including a forward pivot end 34*a* and a rear end 34*b*. Forward end 34*a* defines an arcuate trunnion structure 34*c* defining a convex arcuate outer surface 34*d* and a concave arcuate inner surface 34*e* concentric with respect to outer surface 34*d*. Trunnion structure 34*c* further includes a central longitudinal arcuate slot 34*f* and a transverse slot 34*g* intersecting the longitudinal slot. Main body member 34 further includes longitudinally spaced mounting lugs 34*h*, 34*i* positioned proximate the rear end of the member and a through aperture 34*j* positioned between lugs 34*h* and 34*i*.

Pivot member 36 has a generally U-shaped configuration in cross section, has a width generally corresponding to the width of trunnion structure 34*c*, and includes an outer arcuate surface 36*a* having a radius of curvature substantially matching the radius of curvature of inner trunnion surface 34*e* whereby the pivot member may be rotatably mounted within the trunnion structure. Pivot member 36 further includes a longitudinal slot 36*b* and transverse slots 36*c* at opposite sides of the longitudinal slot. Slots 36*b* and 36*c* correspond generally in size and orientation to the longitudinal and transverse slots 34*f*, 34*g* in the trunnion structure of the main body member 34. Each slot 36*c* opens in outer arcuate surface 36*a*, has a U-configuration in cross section, and includes a central or bottom portion defining an arcuate surface 36*d* and parallel side wall portions 36*e*. Arcuate surface 36*d* is concentric with respect to outer surface 36*a*. Pivot member 36 further includes a tail or tang portion 36*f* projecting outwardly from arcuate surface 36*a* and a detent structure 36*g* constituted by transverse ridge structures on surface 36*a*.

Handle 30 includes a main body elongated portion 30*a*, having a front end 30*b* and a rear end 30*c*, and an actuator arm portion 30*d* extending inwardly from the rear end 30*c* of the main body portion and including an aperture 30*e*. Actuator arm portion 30*d* has a configuration sized to pass through aperture 34*j* in the main body member 34 of the handle structure. The front end 30*b* of the handle main body portion is configured to define an arcuate journal surface 30*f*, a longitudinal fin structure 30*g* projecting forwardly from arcuate surface 30*f*, and a pin structure 30*h* including portions extending transversely from opposite faces of fin structure 30*g*. Pin structure 30*h* has a circular cross-sectional configuration and defines an outer arcuate surface 30*i* that is centered on the central pin axis 30*j* and that is concentric with but spaced radially inwardly with respect to arcuate journal surface 30*f*.

Bell crank 32 includes a first arm portion 32*a*, a second arm portion 32*b*, and a hub portion 32*c*.

To assemble the handle assembly, a coil spring 38 is positioned over bell crank hub portion 32*c*; the bell crank is pivotally mounted between lug portions 34*h* and 34*i* utilizing a bell crank pin 40; the actuator arm 30*d* of the handle 30 is passed downwardly through aperture 34*j* and bell crank arm 32*a* is positioned in actuator arm aperture 30*e*; the front end 30*b* of the handle is moved downwardly with respect to the handle main body member 34 to pass pin 30*h* downwardly through trunnion transverse slots 34*g* and pass fin structure 30*g* downwardly through slot 34*f* to position handle journal surface 30*f* against trunnion outer surface 34*d* and position pin structure 30*h* beneath and within the hollow of the trunnion structure with the pin outer surface 30*i* in concentric radially spaced relation with respect to trunnion surfaces 34*e* and 34*d* and handle surface 30*f*; pivot member 36 is moved upwardly with respect to pin structure 30*h* to move the pin structure 30*h* into the slots 36*c* and pass the pivot member over the pin structure and move fin structure 30*g* into pivot member slot 36*b* whereafter the pivot member is rotated about the central axis 30*j* of the pin structure to move detent ridges 36*e* into coacting detenting engagement with a transverse detent groove structure 34*h* on the inner surface 34*e* of the trunnion structure to lock the pivot member with respect to the trunnion structure. As the detent ridges 36*e* move into coacting detenting engagement with grooves 34*h*, tang portion 36*c* moves into abutting engagement with a stop portion 34*l* of the housing member 34 to further define the locked position of the pivot member with respect to the housing member 34. It will be seen that, in the assembled position of the handle assembly, longitudinal trunnion slot 34*f* is aligned with pivot member longitudinal slot 36*b* to receive fin structure 30*g* and the transverse trunnion slots are aligned with the transverse pivot member slots.

The assembled handle assembly may now be mounted on the door 26 of the vehicle by positioning the handle assembly in a suitable aperture provided in the outer skin 26*a* of the door and securing the housing 34 to the door structure utilizing, for example, a stud 42 passing through an aperture 34*m* of main body housing member 34 and utilizing a further stud (not shown) coacting with a blind bore 34*n* proximate the rear end of the main body housing member 34.

A link or rod 44 operatively associated with a latch 46 carried by a latch face of the door 26 and coacting in known manner with a bolt 50 on the confronting face of the vehicular structure is positioned at a free end 44*a* thereof in an arcuate slot 32*d* provided in bell crank arm portion 32*b*. In operation, and in known manner, as handle 30 is pivoted about the central axis 30*j* of pin 30*h*, actuator arm 30*d* acts to pivot the bell crank lever about the axis of bell crank pin 40 whereby to move link 44 in a manner to control latch member 46.

As the handle moves pivotally about the axis 30*j* of pin structure 30*h*, it will be seen that a large area arcuate bearing interface is provided between the handle and the housing. Specifically, the bearing interface comprises an arcuate inner bearing interface comprising the outer arcuate surface 30*i* of pin structure 30*h* and the inner arcuate surface 36*d* defined by pivot member 36, and an outer bearing interface spaced radially outwardly from the inner bearing interface and defined by trunnion outer arcuate surface 34*d* and handle journal surface 30*f*. The central axis 30*j* of pin structure 30*h* will be seen to define the pivot axis of the handle and it will further be seen that all of the coacting arcuate surfaces defining the bearing interface are centered on the pivot axis 30*j*.

The handle assembly of the invention will be seen to provide many important advantages. Specifically, the large area compound bearing interface provided by the inner and outer bearing interface arrangement provides a firm, positive pivotal action for the handle and ensures that a minimal amount of slop will develop in the pivot axis even over extended periods of vehicle use. Further, the handle pivot construction eliminates the need for a separate pivot pin passing through an exposed pivot pin hole in an exposed visible portion of the housing member whereby to present an aesthetically pleasing appearance to the handle assembly and whereby to eliminate any entry point for water seeking to enter the interior of the door through the handle assembly.

Figure 9:
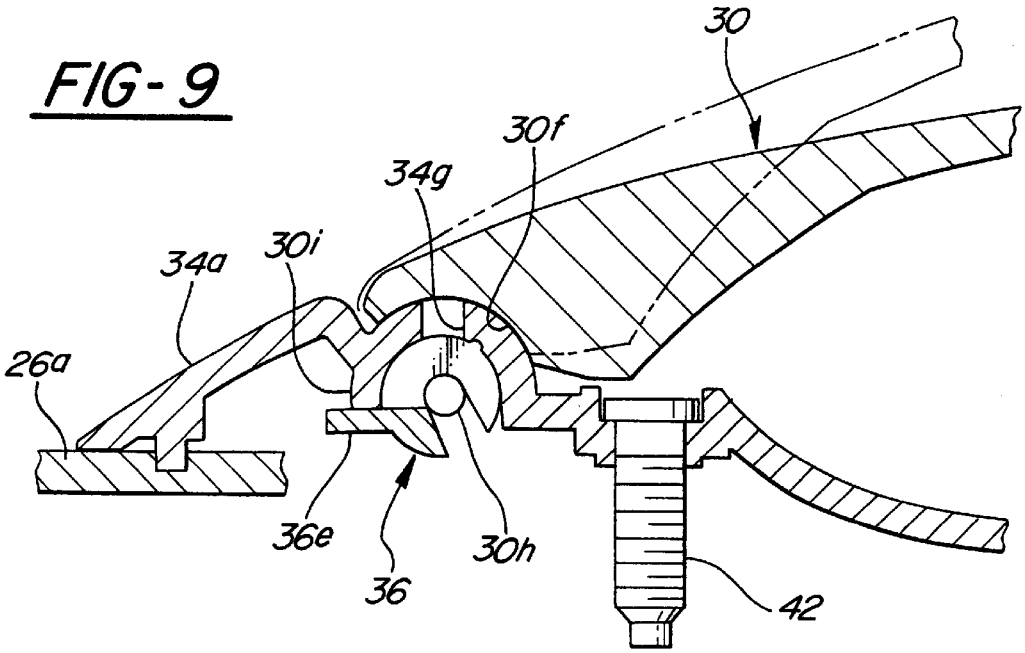
FIG. 9 is a fragmentary somewhat schematic view illustrating the opening movement of the door handle.

Further, and has best seen in FIG. 9, the bearing interface construction of the invention allows the handle pivot axis to be at a relatively "high" location that is essentially planar with respect to the outer skin 26*a* of the door without requiring an exposed pivot pin and pivot pin hole in the handle housing member. The "high" location of the pivot axis relative to the door skin and the handle housing member in turns reduces the gap between the closed position of the handle and the handle housing member required to allow opening movement of the handle to operate the latch. Reduction of this gap is pleasing from a styling standpoint and further reduces the possibility of intrusion of weather elements into the interior of the door through the handle assembly.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A motor vehicle door handle assembly including a housing structure adapted to be mounted on a vehicle door and a handle pivotally mounted on the housing structure at an arcuate bearing interface centered on the handle pivot axis and controlling a latch mechanism for latching and unlatching the door, characterized in that:

the bearing interface comprises an arcuate inner bearing interface comprising coacting first and second interfacing arcuate surfaces on the handle and on the housing structure respectively and an outer bearing interface spaced radially outwardly from the inner bearing interface and comprising coacting third and fourth interfacing arcuate surfaces on the handle and on the housing structure respectively.

2. A motor vehicle door handle assembly including a housing structure adapted to be mounted on a vehicle door and a handle pivotally mounted at one end thereof on the housing structure at an arcuate bearing interface and controlling a latch mechanism for latching and unlatching the door, characterized in that:

the bearing interface comprises an inner bearing interface comprising coacting first and second arcuate surfaces and an outer bearing interface spaced radially outwardly from the inner bearing interface and comprising coacting third and fourth arcuate surfaces;

all of the arcuate surfaces are centered on the handle pivot axis;

the first arcuate surface comprises a radially outwardly facing handle surface;

the second arcuate surface comprises a radially inwardly facing housing structure surface;

the third arcuate surface comprises a radially inwardly facing handle surface; and the fourth arcuate surface comprises a radially outwardly facing housing structure surface.

3. A motor vehicle door handle assembly according to claim 2 wherein:

the first arcuate surface is defined by a pin structure on said one end of the handle; and the third arcuate surface is defined by a journal surface on said one end of the handle in radially outwardly spaced concentric relation to the pin structure.

4. A motor vehicle door handle assembly according to claim 3 wherein the fourth arcuate surface is defined by a convex outer surface of an arcuate trunnion structure of the housing structure interposed concentrically between the pin structure and the third arcuate surface.

5. A motor vehicle door handle assembly according to claim 4 wherein:

the handle includes a longitudinal fin structure at said one end thereof;

the pin structure includes portions extending transversely from opposite faces of the fin structure;

the trunnion structure includes a longitudinal slot sized to pass the fin structure and a transverse slot intersecting the longitudinal slot and sized to pass the pin structure; and the handle is assembled to the housing structure by passing the fin structure and the pin structure downwardly through the transverse and longitudinal slots respectively to position the journal surface against the outer convex surface of the trunnion structure and position the pin structure beneath and within the hollow of the trunnion structure.

6. A motor vehicle door handle assembly according to claim 5 wherein:

the housing structure comprises a main body member adapted to be mounted on the vehicle door and a pivot member;

the main body member defines the trunnion structure;

the trunnion structure further defines a concave inner surface in concentric relation to the pin structure; and the pivot member is positioned between the inner concave surface of the trunnion structure and the pin structure and includes a longitudinal slot aligned with the longitudinal slot in the trunnion structure and receiving the longitudinal fin structure and transverse slots at opposite sides of the longitudinal slot aligned with the transverse slot in the trunnion structure and receiving the respective pin structure portions.

7. A motor vehicle door handle assembly according to claim 6 wherein the handle assembly further includes coacting detent structures on the pivot member and on the concave inner surface of the trunnion structure operative in response to rotation of the pivot member about the handle pivot axis to lock the pivot member with respect to the main body member.

8. A motor vehicle door handle assembly according to claim 6 wherein the pivot member has an overall U-configuration in cross section to facilitate positioning of the pivot member around the pin structure and subsequent rotation of the pivot member about the handle pivot axis to its detented position.

9. A motor vehicle door handle assembly including a housing structure adapted to be mounted on a vehicle door and a handle pivotally mounted on the housing structure at an arcuate bearing interface centered on the handle pivot axis and controlling a latch mechanism for latching and unlatching the door, characterized in that:

the bearing interface comprises an arcuate inner bearing interface comprising coacting first and second arcuate surfaces on the handle and on the housing structure respectively and an outer bearing interface spaced radially outwardly from the inner bearing interface and comprising coacting third and fourth arcuate surfaces on the handle and on the housing structure respectively;

the first arcuate surface comprises a radially outwardly facing handle surface;

the second arcuate surface comprises a radially inwardly facing housing structure surface;

the third arcuate surface comprises a radially inwardly facing handle surface; and the fourth arcuate surface comprises a radially outwardly facing housing structure surface.

10. A motor vehicle door handle assembly according to claim 9 wherein:

the housing structure comprises a main body member adapted to be mounted on the vehicle door and a pivot member mounted on the main body member in concentric relation to the pivot axis;

the second arcuate surface is defined by the pivot member; and the fourth arcuate surface is defined by the main body member.

* * * * *